US008844402B2

(12) United States Patent
Ulmann

(10) Patent No.: US 8,844,402 B2
(45) Date of Patent: Sep. 30, 2014

(54) CRANK HANDLE APPARATUS WITH FOLD-AWAY HANDLE

(75) Inventor: Pierre Ulmann, Vaud (CH)

(73) Assignee: Honeywell International Inc., Morristown, NJ (US)

( * ) Notice: Subject to any disclaimer, the term of this patent is extended or adjusted under 35 U.S.C. 154(b) by 18 days.

(21) Appl. No.: 13/314,363

(22) Filed: Dec. 8, 2011

(65) Prior Publication Data

US 2013/0145895 A1 Jun. 13, 2013

(51) Int. Cl.
*G05G 1/00* (2008.04)

(52) U.S. Cl.
USPC ..... 74/547

(58) Field of Classification Search
USPC ..... 74/543, 545, 547; 16/429, 438, 445
See application file for complete search history.

(56) References Cited

U.S. PATENT DOCUMENTS

| | | | | |
|---|---|---|---|---|
| 1,191,855 | A * | 7/1916 | Tuszka | 74/547 |
| 1,330,260 | A * | 2/1920 | Graham et al. | 74/547 |
| 2,455,819 | A * | 12/1948 | Smith | 242/395.1 |
| 3,109,347 | A * | 11/1963 | Brodl et al. | 92/113 |
| 3,536,299 | A * | 10/1970 | Rucker et al. | 254/369 |
| 3,863,860 | A * | 2/1975 | Quenot | 242/395.1 |
| 4,368,856 | A | 1/1983 | Neufeld | |
| 4,479,616 | A | 10/1984 | Kovalovsky | |
| 4,552,034 | A * | 11/1985 | Bertani et al. | 74/547 |
| 5,507,204 | A | 4/1996 | Diffrient | |
| 5,513,544 | A | 5/1996 | Winkler et al. | |
| 5,823,067 | A | 10/1998 | Clarys et al. | |
| 7,082,644 | B2 | 8/2006 | Senner | |
| 7,575,188 | B2 * | 8/2009 | Mullen et al. | 242/405.2 |
| 7,766,272 | B2 * | 8/2010 | Ni | 242/395.1 |

OTHER PUBLICATIONS

EP Search Report for EP Application 12195043.0 dated Jan. 3, 2014.

* cited by examiner

*Primary Examiner* — Vicky Johnson
(74) *Attorney, Agent, or Firm* — Kermit D. Lopez; Luis M. Ortiz; Ortiz & Lopez, PLLC

(57) ABSTRACT

A crank handle apparatus with a fold-away handle and a rotation locking mechanism. The apparatus includes an arm, a fold-away handle attached to a first end of the arm, and a crank wheel attached to a second end of the arm. The fold-away handle in a stored position can be moved to an operating position by un-folding the handle. The handle further includes a ring that can be pulled after un-folding the handle so that an index pin located inside the second end of the arm along a first axis enables rotation of the crank wheel along a second axis. The ring can be pulled to move the index pin along with the fold-away handle to secure the fold-away handle against folding back during operation of the crank handle apparatus.

18 Claims, 9 Drawing Sheets

CRANK HANDLE APPARATUS WITH FOLD-AWAY HANDLE

TECHNICAL FIELD

Embodiments are generally related to crank handles. Embodiments are also related to rotation locking devices. Embodiments are additionally related to fold-away handles.

BACKGROUND OF THE INVENTION

Crank handles can be employed in a variety of equipment to increase the torque applied to an axis of rotation. A crank handle generally includes an arm attached at right angles to a rotating shaft by which a reciprocating motion is imparted to or received from the shaft. The crank handle can be utilized to change circular into reciprocating motion, or reciprocating into circular motion. A connecting rod is typically connected to the crank via pivot. The end of the rod attached to the crank moves in a circular motion, while the other end is usually constrained to move in a linear sliding motion (e.g., "in and out").

Conventional crank handles include a protruding handle that unfortunately can interfere with the operation of the equipment to which the handle is attached. A hinged joint may be placed along the body of the crank handle so that a portion of the crank handle is retractable and the crank handle is less likely to protrude. Such retractable crank handles, however, are difficult to operate because alignment between the hinged portions is difficult to maintain during rotation of the handle. Additionally, such crank handle devices are awkward to operate and may damage the handle by placing unintended forces on the hinge.

Based on the foregoing, it is believed that a need exists for an improved crank handle apparatus with a fold-away handle. A need also exists for an improved rotation locking mechanism, as will be described in greater detail herein.

BRIEF SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings, and abstract as a whole.

It is, therefore, one aspect of the disclosed embodiments to provide for an improved crank handle apparatus with a fold-away handle.

It is another aspect of the disclosed embodiments to provide for an improved rotation locking mechanism.

The aforementioned aspects and other objectives and advantages can now be achieved as described herein. A crank handle apparatus with a fold-away handle and a rotation locking mechanism is disclosed herein. The apparatus includes an arm, a fold-away handle attached to a first end of the arm, and a crank wheel attached to a second end of the arm. The fold-away handle in a stored position can be moved to an operating position by un-folding the handle. The handle further includes a ring that can be pulled after un-folding the handle so that an index pin located inside the second end of the arm along a first axis enables rotation of the crank wheel along a second axis. The ring can be pulled to move the index pin along with the fold-away handle to secure the fold-away handle against folding back during operation of the crank handle apparatus. The handle can be positively locked in the operating position and rest in the stored position.

A number of embodiments, preferred and alternative, are therefore disclosed. For example, in one embodiment, a crank handle apparatus can be implemented, which includes a fold-away handle attached to a first end of an arm and a crank wheel attached to a second end of the arm wherein the fold-away handle in a stored position is moved to an operating position by un-folding the fold-away handle. Such an apparatus can also include a ring attached to the fold-away handle that is pulled after un-folding the fold-away handle so that an index pin located within the second end of the arm along a first axis enables rotation of the crank wheel along a second axis wherein the index pin moves along with the fold-away handle to prevent the fold-away handle from folding back during an operation of the apparatus.

In another embodiment, the fold-away handle can be positively locked in an operating position and rests in a stored position. In yet another embodiment, a spring can be located within the arm. In other embodiments, such a spring can be a compression spring. In general, such a spring can assist turning the fold-away handle to a correct resting position with respect to the crank wheel. In other embodiments, a tilted surface can be located on the arm and the second end. In other embodiments, the arm can be attached at right angles with respect to the crank wheel such that a reciprocating motion is impartable or receivable from the crank wheel. In still other embodiments, a torsion spring can be provided, which enhances the folding back to resting position of the apparatus upon release of a pull of the ring.

In still other embodiments, an alternatve crank handle apparatus can be provided, which includes a fold-away handle attached to a first end of an arm and a crank wheel attached to a second end of the arm wherein the fold-away handle in a stored position is moved to an operating position by un-folding the fold-away handle; and a ring associated with the fold-away handle, such that the fold-away handle is pullable after unfolding the fold-away handle so that an index pin located within the second end of the arm along a first axis enables rotation of the crank wheel along a second axis wherein the index pin moves along with the fold-away handle to prevent the fold-away handle from folding back during an operation of the apparatus and wherein the fold-away handle is positively locked in an operating position and rests in a stored position.

In yet other embodiments, a crank handle apparatus can be configured, which includes a fold-away handle attached to a first end of an arm and a crank wheel attached to a second end of the arm wherein the fold-away handle in a stored position is moved to an operating position by un-folding the fold-away handle; a ring attached to the fold-away handle that is pulled after un-folding the fold-away handle so that an index pin located within the second end of the arm along a first axis enables rotation of the crank wheel along a second axis wherein the index pin moves along with the fold-away handle to prevent the fold-away handle from folding back during an operation of the apparatus; and a spring located within the arm, wherein the spring assists in turning the fold-away handle toward a correct resting position with the crank wheel.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION

The particular values and configurations discussed in these non-limiting examples can be varied and are cited merely to illustrate at least one embodiment and are not intended to limit the scope thereof.

The embodiments will now be described more fully hereinafter with reference to the accompanying drawings, in which illustrative embodiments of the invention are shown. The embodiments disclosed herein can be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. As used herein, the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Figure 1:
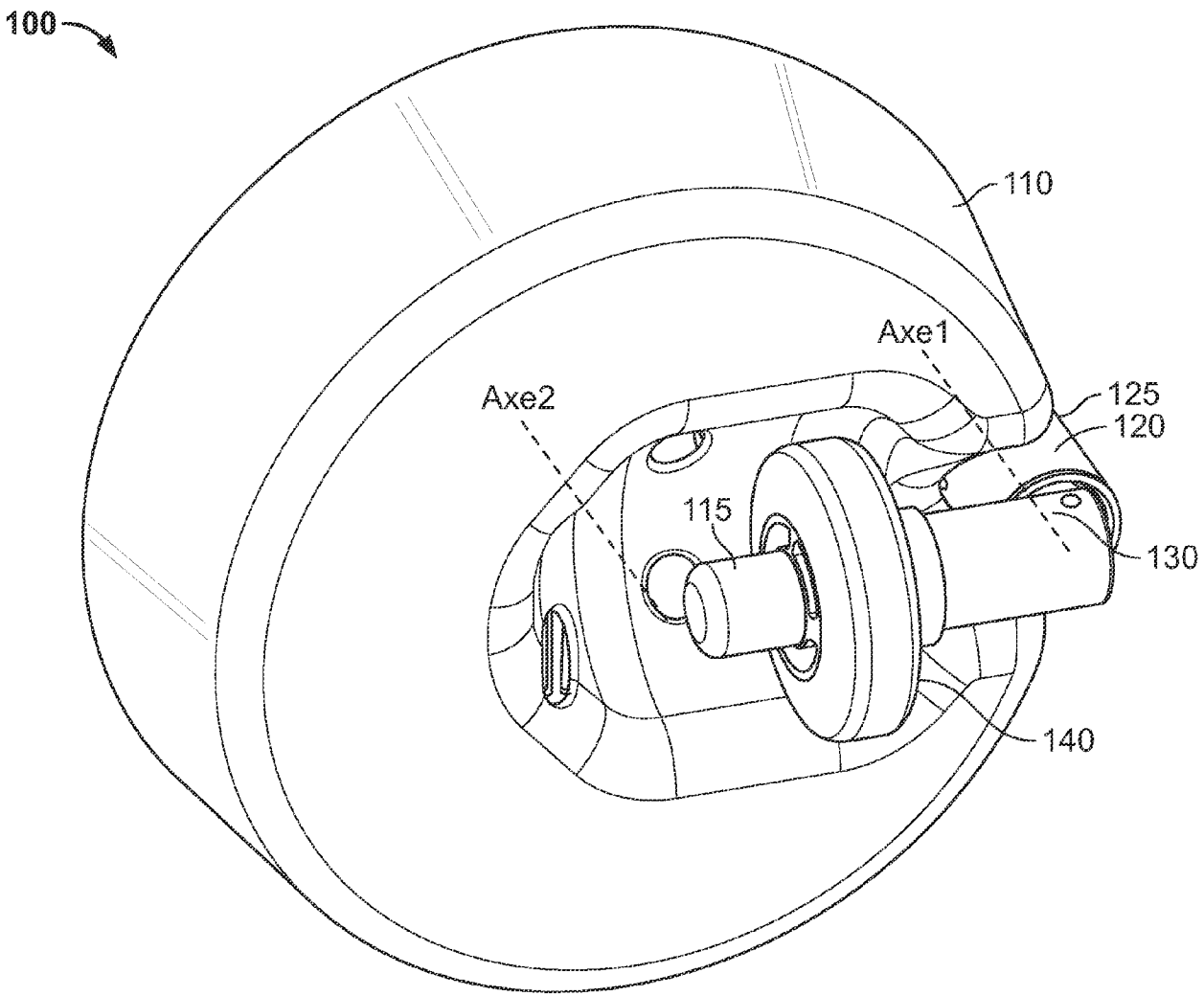
FIGS. 1-3 illustrate a front view of a crank handle apparatus with a fold-away handle, in accordance with the disclosed embodiments.
Figure 2:
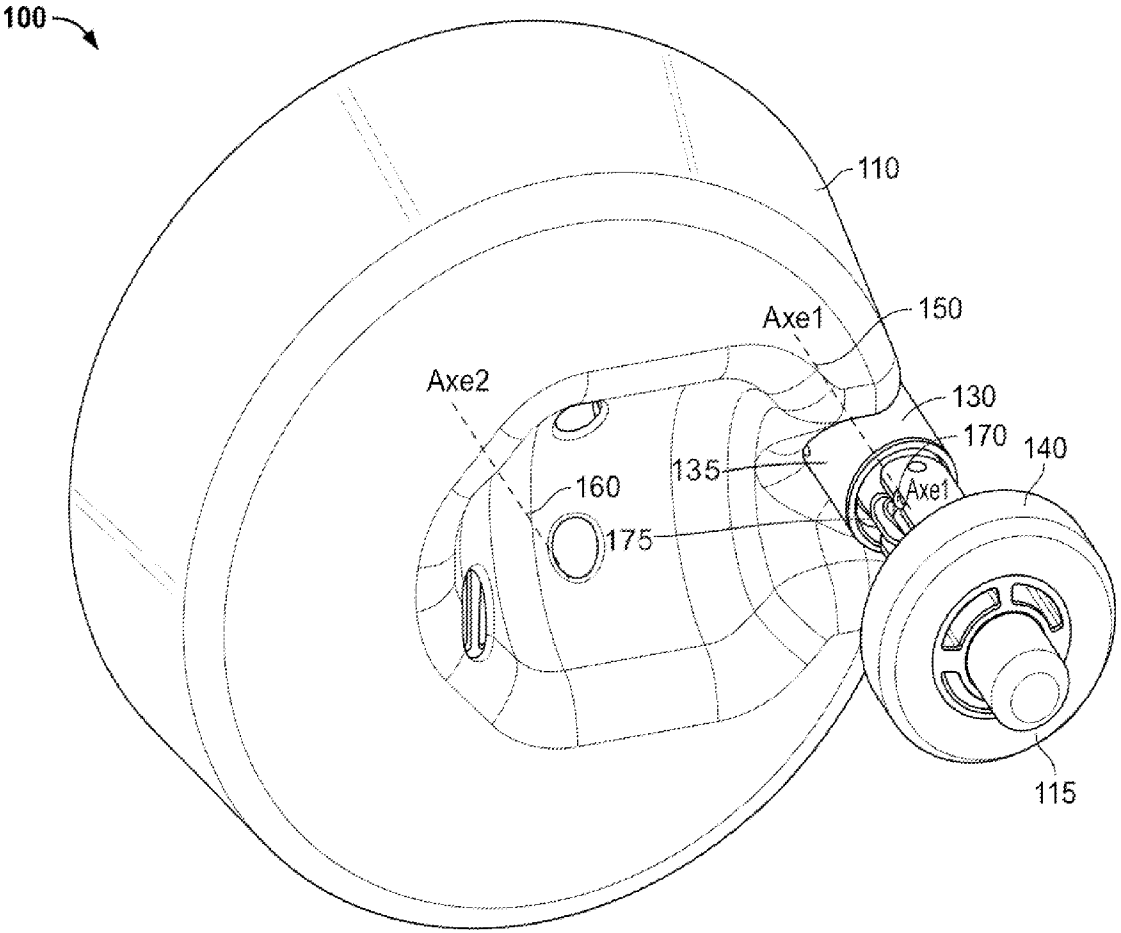
Figure 3:
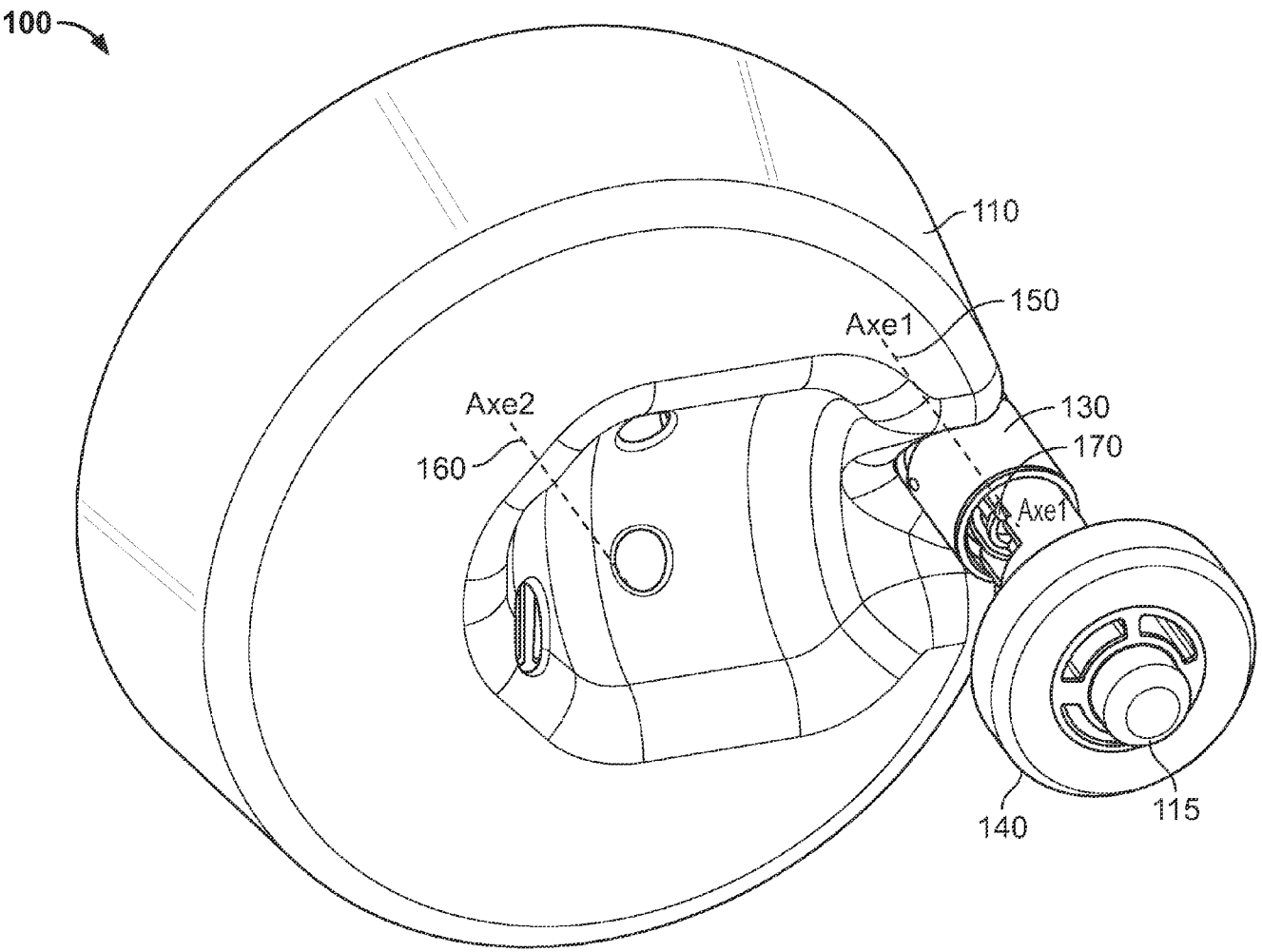

FIGS. 1-3 illustrate a front view of a crank handle apparatus 100 with a fold-away handle 130, in accordance with the disclosed embodiments. The crank handle apparatus 100 can be employed in a variety of equipment to, for example, adjust the position of a work surface on fabricating equipment, raise and lower retractable wheels on a trailer, rotate a take-up barrel on winching equipment, and so forth. The crank handle apparatus 100 includes an arm 120, a fold-away handle 130 attached to a first end 115 of the arm 120, and a crank wheel 110 attached to a second end 125 of the arm 120. The fold-away handle 130 further includes a ring 140 attached to the fold-away handle 130 and an index pin 170 located inside the second end 125 of the arm 120. The crank handle 130 can be bent over the wheel 110. The fold-away handle 130 is in a stored position and can be moved to an operating position by un-folding the fold-away handle 130. Note that in some embodiments, the folding back to resting position can be enhanced through the use of a torsion spring 175 when, for example, a user releases from pulling the ring 140. Additionally, a compression spring within the arm 120 can in some embodiments, also act on turning the handle 130 into the correct resting position to the wheel 110. Note that there is also a tilted surface 135 on arm 120 and at the second end 125 so that the arm end 115 points towards axe 2.

Figure 4:
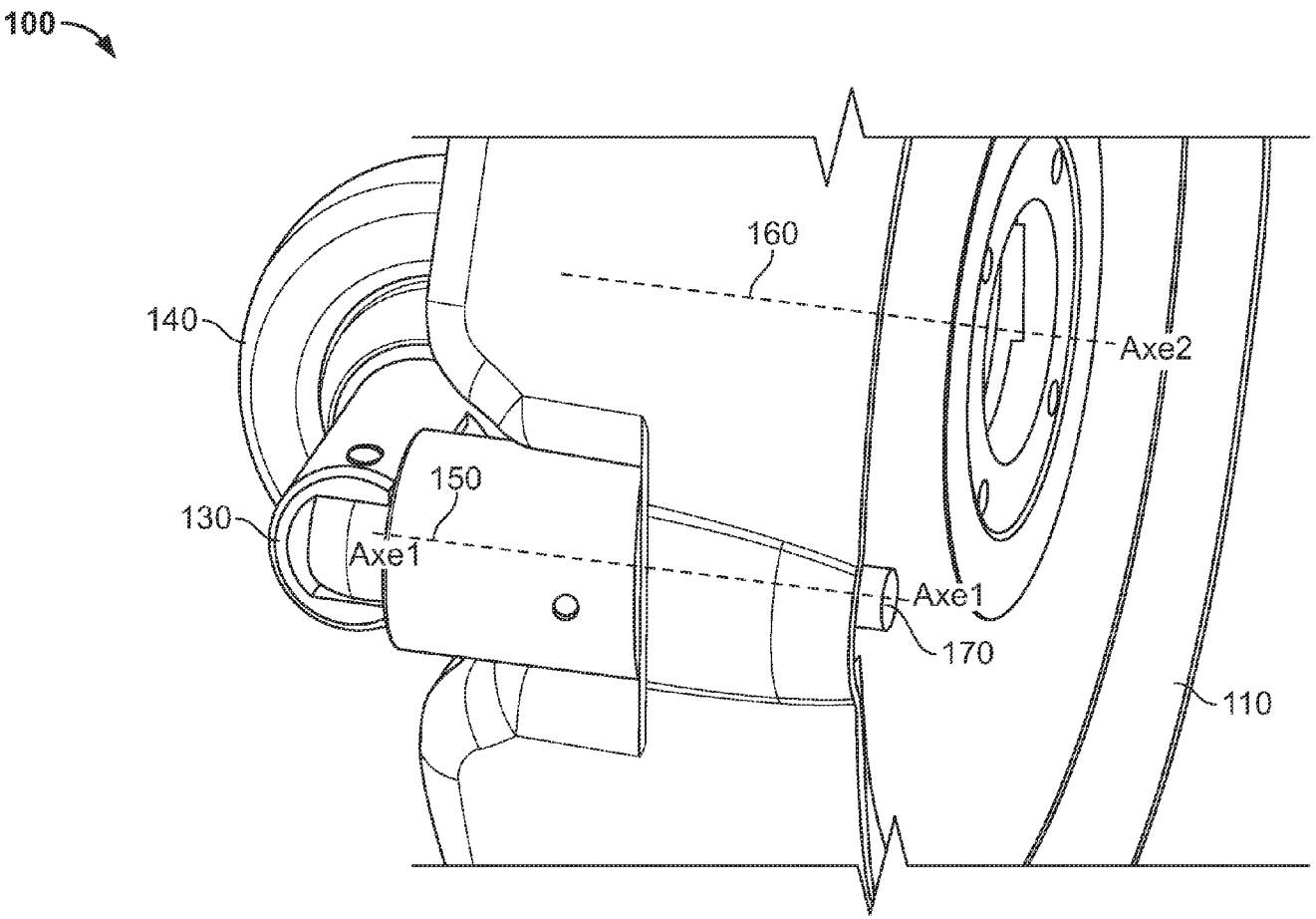
FIGS. 4-6 illustrate a side view of the crank handle apparatus with the fold-away handle, in accordance with the disclosed embodiments.
Figure 5:
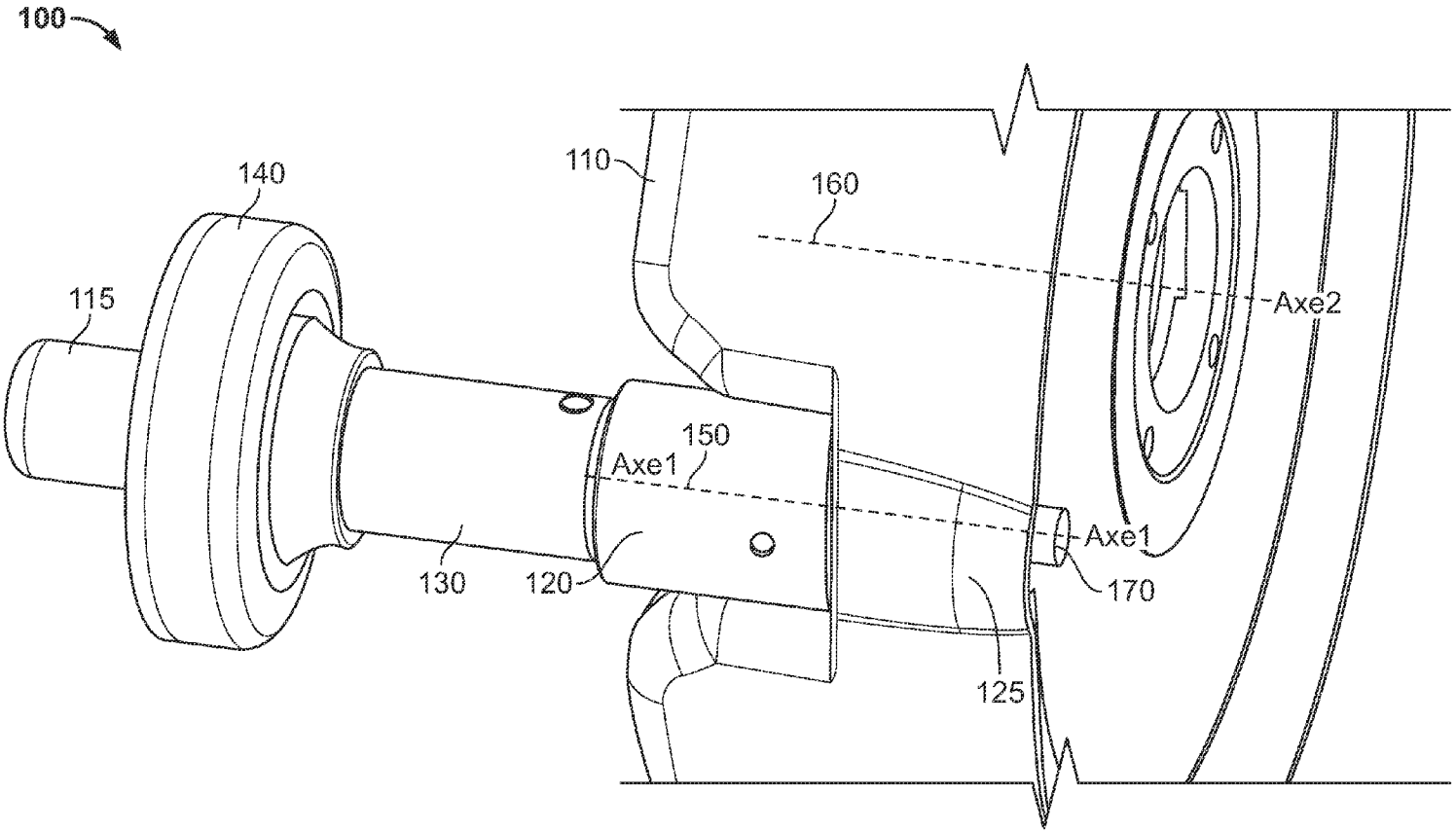
Figure 6:
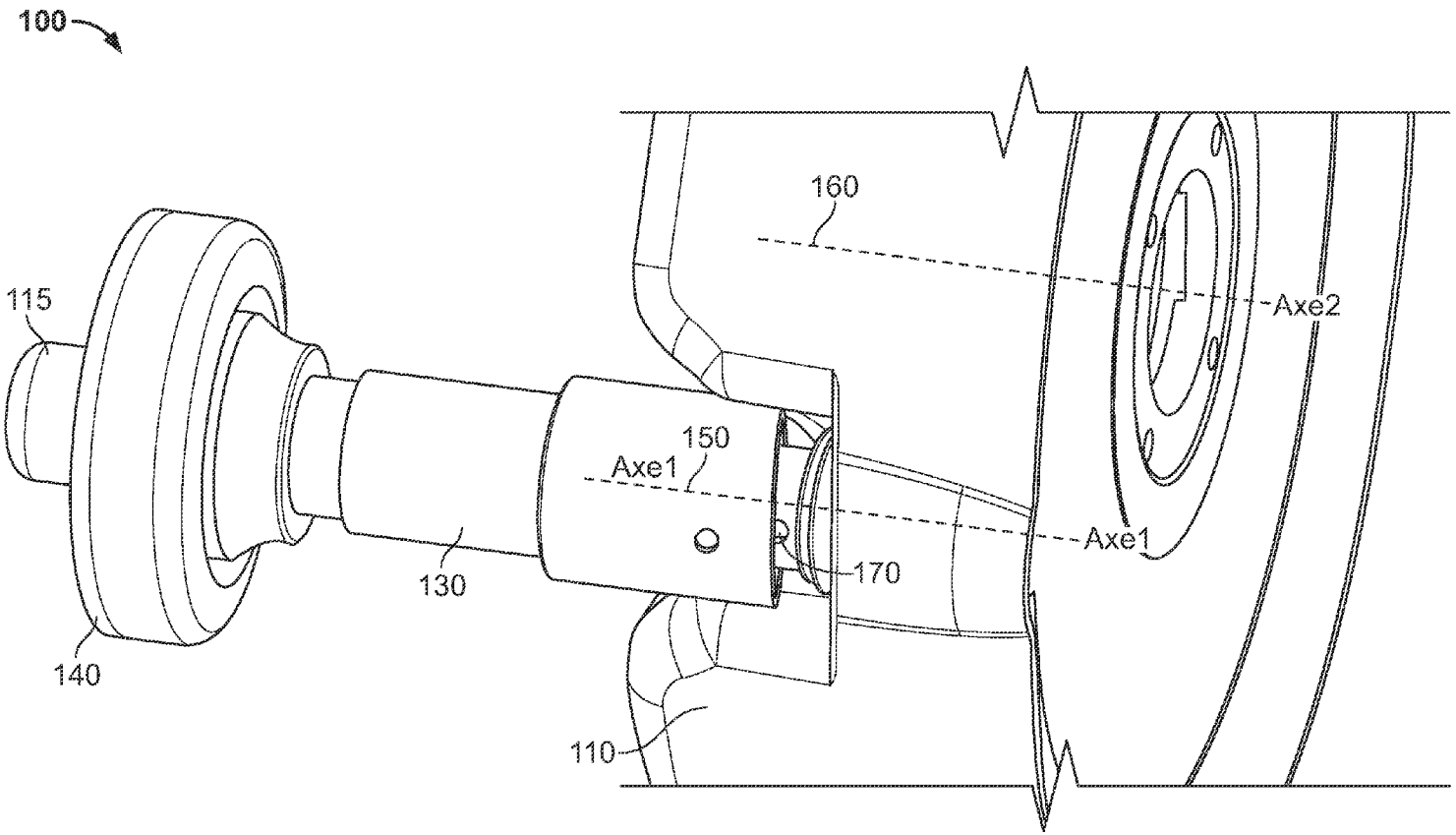

FIGS. 4-6 illustrate a side view of the crank handle apparatus 100 with the fold-away handle 130, in accordance with the disclosed embodiments. Note that in FIGS. 1-9 identical parts or elements are generally indicated by identical reference numerals. The ring 140 can be pulled after un-folding the fold-away handle 130 so that the index pin 170 located inside the second end 125 of the arm 120 along a first axis 150 enables rotation of the crank wheel 110 along a second axis 160. The arm 120 can be attached at right angles to the wheel 110 by which reciprocating motion can be imparted to or received from the wheel 110.

Figure 7:
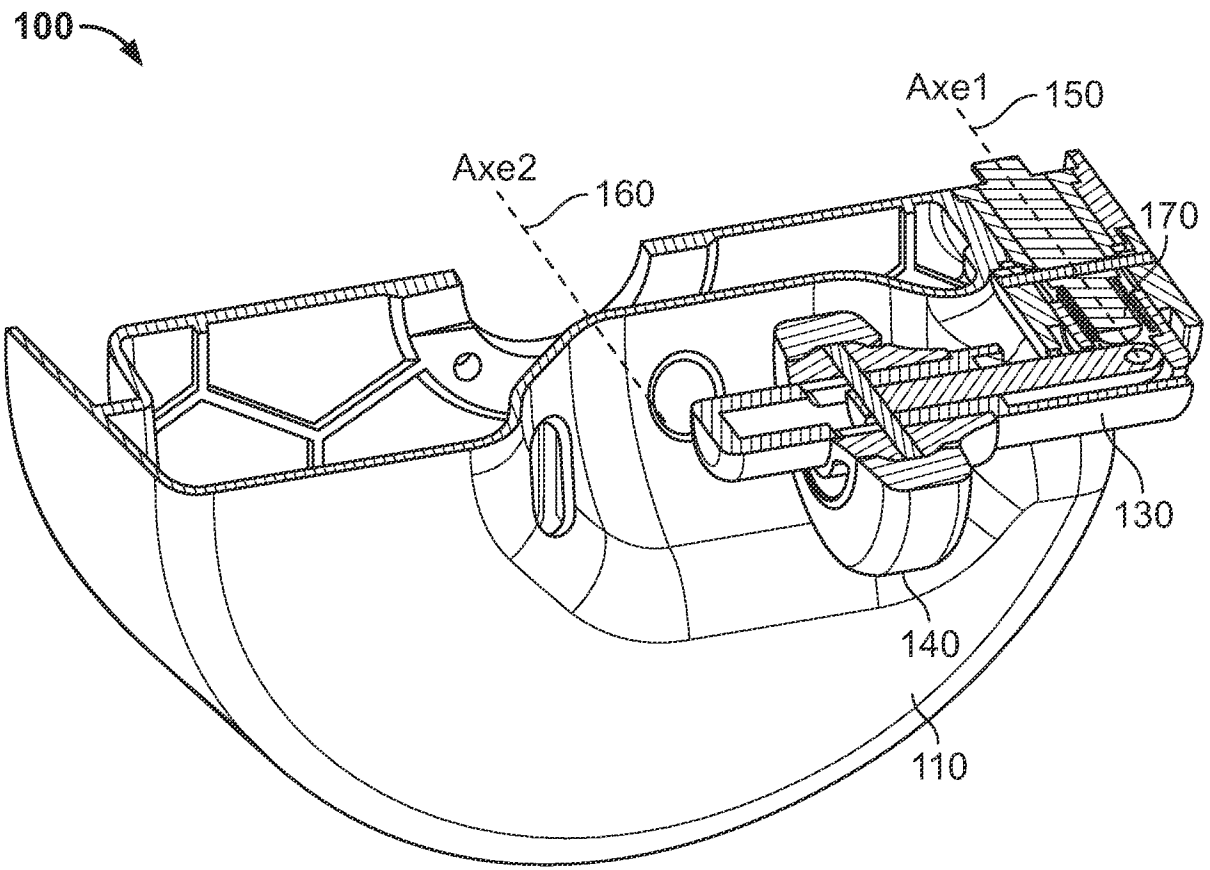
FIGS. 7-9 illustrate a sectional view of the crank handle apparatus with the fold-away handle, in accordance with the disclosed embodiments.
Figure 8:
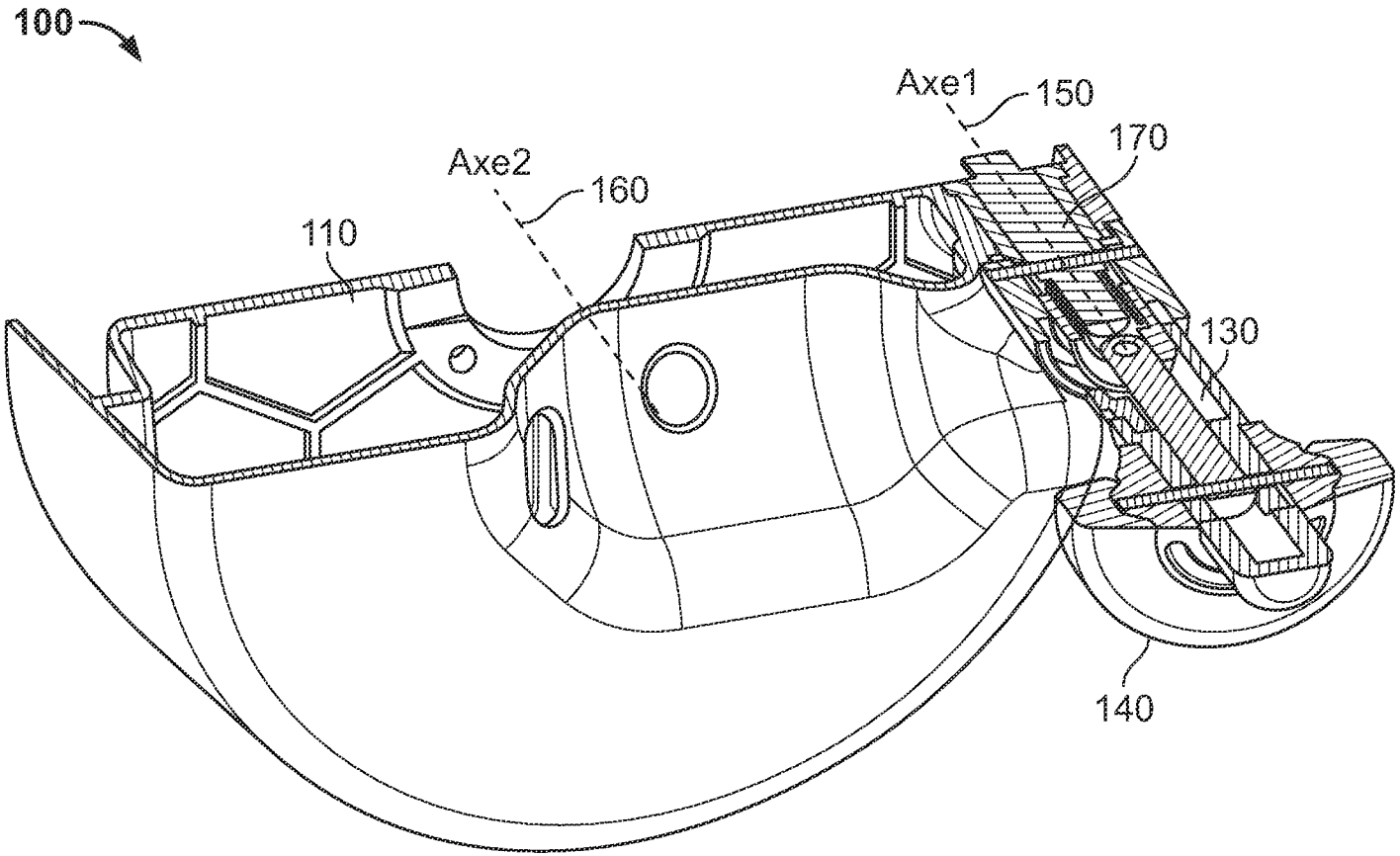
Figure 9:
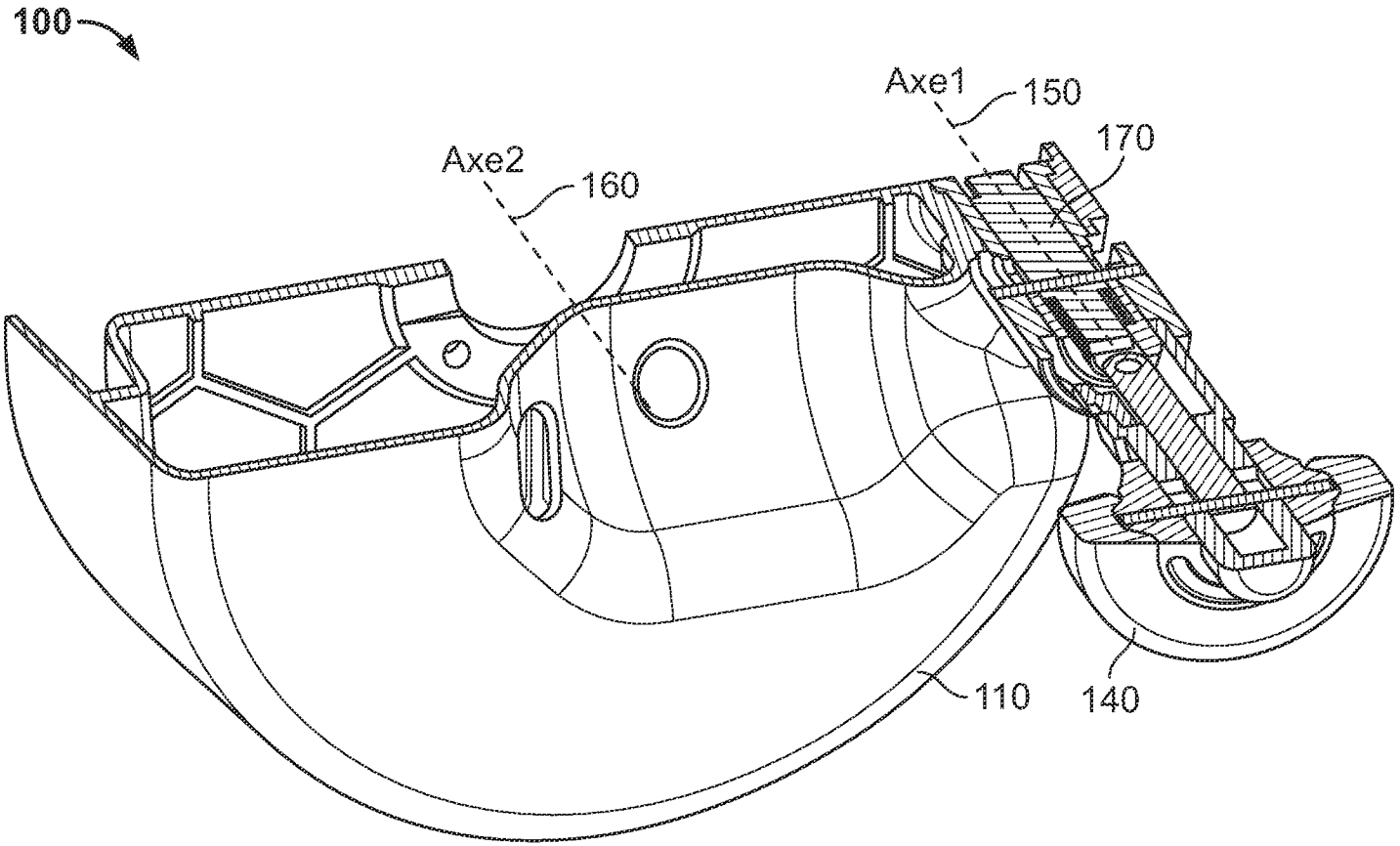

FIGS. 7-9 illustrate a sectional view of the crank handle apparatus 100 with the fold-away handle 130, in accordance with the disclosed embodiments. The ring 140 can be pulled to move the index pin 170 along with the fold-away crank handle 130 to secure the fold-away crank handle 130 against folding back during operation of the crank handle apparatus 100. The fold-away crank handle 130 is positively locked in the operating position by moving the index pin 170 also a ring over part of the fold-away crank handle 130.

The index pin 170 prevents the fold-away crank handle 130 from folding back during operation of the crank handle apparatus 100. The handle 130 can be positively locked in the operating position and simply rest in the stored position. The crank handle apparatus 100 can be readily adapted to a variety of ranges of operation, has a comparatively low cost of construction, is readily assembled, and presents a low risk of damage to the equipment to which the handle is attached during assembly or operation. Various alterations and modifications will occur to those skilled in the art from the foregoing detailed description of the invention and the accompanying drawings.

Based on the foregoing, it can be appreciated that a number of embodiments, preferred and alternative, are disclosed. For example, in one embodiment, a crank handle apparatus can be implemented, which includes a fold-away handle attached to a first end of an arm and a crank wheel attached to a second end of the arm wherein the fold-away handle in a stored position is moved to an operating position by un-folding the fold-away handle. Such an apparatus can also include a ring attached to the fold-away handle that is pulled after un-folding the fold-away handle so that an index pin located within the second end of the arm along a first axis enables rotation of the crank wheel along a second axis wherein the index pin moves along with the fold-away handle to prevent the fold-away handle from folding back during an operation of the apparatus.

In another embodiment, the fold-away handle can be positively locked in an operating position and rests in a stored position. In yet another embodiment, a spring can be located within the arm. In other embodiments, such a spring can be a compression spring. In general, such a spring can assist turning the fold-away handle to a correct resting position with respect to the crank wheel. In other embodiments, a tilted surface can be located on the arm and the second end. In other embodiments, the arm can be attached at right angles with respect to the crank wheel such that a reciprocating motion is impartable or receivable from the crank wheel. In still other embodiments, a torsion spring can be provided, which enhances the folding back to resting position of the apparatus upon release of a pull of the ring.

In still other embodiments, an alternatve crank handle apparatus can be provided, which includes a fold-away handle attached to a first end of an arm and a crank wheel attached to a second end of the arm wherein the fold-away handle in a stored position is moved to an operating position by un-folding the fold-away handle; and a ring associated with the fold-away handle, such that the fold-away handle is pullable after unfolding the fold-away handle so that an index pin located within the second end of the arm along a first axis enables rotation of the crank wheel along a second axis wherein the index pin moves along with the fold-away handle to prevent the fold-away handle from folding back during an operation of the apparatus and wherein the fold-away handle is positively locked in an operating position and rests in a stored position.

In yet other embodiments, a crank handle apparatus can be configured, which includes a fold-away handle attached to a first end of an arm and a crank wheel attached to a second end of the arm wherein the fold-away handle in a stored position is moved to an operating position by un-folding the fold-away handle; a ring attached to the fold-away handle that is pulled after un-folding the fold-away handle so that an index pin located within the second end of the arm along a first axis enables rotation of the crank wheel along a second axis wherein the index pin moves along with the fold-away handle to prevent the fold-away handle from folding back during an operation of the apparatus; and a spring located within the arm, wherein the spring assists in turning the fold-away handle toward a correct resting position with the crank wheel.

It will be appreciated that variations of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

The invention claimed is:

1. A crank handle apparatus, said apparatus comprising:

a fold-away handle and a crank wheel wherein a first end of an arm is attached to said fold away handle and a second end of said arm is attached to said crank wheel wherein said fold-away handle in a stored position is moved to an operating position by un-folding said fold-away handle;

a ring attached to said fold-away handle that is pulled after un-folding said fold-away handle so that an index pin located within said second end of said arm along a first axis enables rotation of said crank wheel along a second axis wherein said index pin moves along with said fold-away handle to prevent said fold-away handle from folding back during an operation of said apparatus; and a torsion spring that enhances a folding back to resting position of said fold away handle upon release of a pull of said ring.

2. The apparatus of claim 1 wherein said fold-away handle is positively locked in an operating position and rests in a stored position.

3. The apparatus of claim 1 further comprising a spring within said arm.

4. The apparatus of claim 3 wherein said spring comprises a compression spring.

5. The apparatus of claim 3 wherein said spring assists in turning said fold-away handle into a correct resting position with respect to said crank wheel.

6. The apparatus of claim 1 further comprising a tilted surface on said second end of said arm.

7. The apparatus of claim 1 wherein said arm is attached at right angles with respect to said crank wheel such that a reciprocating motion is impartable or receivable from rotation of said crank wheel.

8. A crank handle apparatus, said apparatus comprising:

a fold-away handle and a crank wheel wherein a first end of an arm is attached to said fold away handle and a second end of said arm is attached to said crank wheel wherein said fold-away handle in a stored position is moved to an operating position by un-folding said fold-away handle;

a ring associated with said fold-away handle, such that said fold-away handle is pullable after unfolding said fold-away handle so that an index pin located within said second end of said arm along a first axis enables rotation of said crank wheel along a second axis wherein said index pin moves along with said fold-away handle to prevent said fold-away handle from folding back during an operation of said apparatus and wherein said fold-away handle is positively locked in an operating position and rests in a stored position; and a torsion spring that enhances a folding back to resting position of said fold away handle upon release of a pull of said ring.

9. The apparatus of claim 8 wherein said ring is attached to said fold-away handle.

10. The apparatus of claim 8 further comprising a spring within said arm.

11. The apparatus of claim 10 wherein said spring comprises a compression spring.

12. The apparatus of claim 10 wherein said spring assists in turning said fold-away handle into a correct resting position with respect to said crank wheel.

13. The apparatus of claim 8 further comprising a tilted surface on said second end of said arm.

14. The apparatus of claim 8 wherein said arm is attached at right angles with respect to said crank wheel such that a reciprocating motion is impartable or receivable from rotation of said crank wheel.

15. A crank handle apparatus, said apparatus comprising:

a fold-away handle and a crank wheel wherein a first end of an arm is attached to said fold away handle and a second end of said arm is attached to said crank wheel wherein said fold-away handle in a stored position is moved to an operating position by un-folding said fold-away handle;

a ring attached to said fold-away handle that is pulled after un-folding said fold-away handle so that an index pin located within said second end of said arm along a first axis enables rotation of said crank wheel along a second axis wherein said index pin moves along with said fold-away handle to prevent said fold-away handle from folding back during an operation of said apparatus; and a torsion spring that enhances a folding back to resting position of said fold away handle upon release of a pull of said ring.

16. The apparatus of claim 15 wherein said fold-away handle is positively locked in an operating position and rests in a stored position.

17. The apparatus of claim 15 further comprising a compression spring.

18. The apparatus of claim 15 further comprising a tilted surface on said second end of said arm.

* * * * *